US005334321A

United States Patent [19]

Harrison et al.

[11] Patent Number: 5,334,321

[45] Date of Patent: Aug. 2, 1994

[54] MODIFIED HIGH MOLECULAR WEIGHT SUCCINIMIDES

[75] Inventors: James J. Harrison, Novato; William R. Ruhe, Jr., Benicia, both of Calif.

[73] Assignee: Chevron Research and Technology Company, a Division of Chevron U.S.A. Inc., San Francisco, Calif.

[21] Appl. No.: 28,433

[22] Filed: Mar. 9, 1993

[51] Int. Cl.[5] ..... C10M 133/44

[52] U.S. Cl. ..... 252/51.5 A; 252/51.5 R; 548/545; 548/546; 549/228; 549/229

[58] Field of Search ..... 252/51.5 A, 51.5 R; 548/545, 546; 549/228, 229

[56] References Cited

U.S. PATENT DOCUMENTS 4,584,117 4/1986 Wollenberg ..... 252/51.5 R
4,612,132 9/1986 Wollenberg et al. ..... 252/51.5 A
4,713,188 12/1987 Wollenberg ..... 252/51.5 R
4,755,312 7/1988 Wollenberg ..... 252/51.5 R
4,840,744 6/1989 Wollenberg et al. ..... 252/51.5 R

*Primary Examiner*—Jacqueline V. Howard
*Attorney, Agent, or Firm*—E. A. Schaal; W. K. Turner

[57] ABSTRACT

Alkenyl or alkyl succinimide additives which are the reaction product of a high molecular weight alkenyl- or alkyl-substituted succinic anhydride and a polyalkylene polyamine having an average of greater than 4 nitrogen atoms per mole, wherein the reaction product is post-treated with a cyclic carbonate, are compatible with fluorocarbon engine seals and, for concentration levels at which fluorocarbon seal compatibility is achieved, possess improved dispersancy and/or detergency properties when employed in lubricating oils and fuels,

37 Claims, No Drawings

MODIFIED HIGH MOLECULAR WEIGHT SUCCINIMIDES

BACKGROUND OF THE INVENTION

1. Field of the Invention

This invention relates to additives which are compatible with fluorocarbon seals and are useful as dispersants and/or detergents in lubricating oils. In particular, this invention is directed toward modified polyamino alkenyl or alkyl succinimides which are the reaction product of an alkenyl- or alkyl-substituted succinic anhydride and a polyalkylene polyamine, wherein the reaction product is post-treated with a cyclic carbonate. The modified polyamino alkenyl or alkyl succinimides of this invention have been found to be compatible with fluorocarbon seals and, for concentration levels at which fluorocarbon seal compatibility is achieved, to possess improved dispersancy and/or detergency properties when employed in a lubricating oil. These modified succinimides are also useful as detergents and/or dispersants in fuels.

2. Prior Art

It is known in the art that alkenyl- or alkyl-substituted succinic anhydrides have been used as dispersants and/or detergents in lubricating oils and fuels. Such alkenyl- or alkyl-substituted succinic anhydrides have been prepared by three well-known processes: a thermal process (see, e.g., U.S. Pat. No. 3,361,673), a chlorination process (see, e.g., U.S. Pat. No. 3,172,892) and a combination of the thermal and chlorination processes (see, e.g., U.S. Pat. No. 3,912,764). The polyisobutenyl succinic anhydride ("PIBSA") produced by the thermal process has been characterized as a monomer containing a double bond in the product. Although the exact structure of chlorination PIBSA has not been definitively determined, the chlorination process PIBSA materials have been characterized as monomers containing either a double bond, a ring other than succinic anhydride ring and/or chlorine in the product. [(See J. Weill and B. Sillion, "Reaction of Chlorinated Polyisobutene with Maleic Anhydride: Mechanism Catalysis by Dichloramaleic Anhydride", Revue de l'Institut Francais du Petrole, Vol. 40, No. 1, pp. 77–89 (January-February, 1985).] Such compositions include one-to-one monomeric adducts (see, e.g., U.S. Pat. Nos. 3,219,666; 3,381,022) as well as "multiply adducted" products, adducts having alkenyl-derived substituents adducted with at least 1.3 succinic groups per alkenyl-derived substituent (see, e.g., U.S. Pat. No. 4,234,435).

Alkenyl or alkyl succinimides formed by the reaction of an alkenyl- or alkyl-substituted succinic anhydride and a polyamine are also well known as lubricating oil dispersant and/or detergent additives. See, e.g., U.S. Pat. Nos. 3,361,673 and 3,018,250.

As taught in U.S. Pat. No. 4,612,132 ("the '132 patent"), alkenyl or alkyl succinimides may be modified such that one or more of the nitrogens of the polyamine moiety is substituted with a hydrocarbyl oxycarbonyl, a hydroxyhydrocarbyl oxycarbonyl or a hydroxy poly-(oxyalkylene) oxycarbonyl. These modified succinimides, which impart improved dispersancy and/or detergency properties when employed in lubricating oils, are obtained by reacting the product of an alkyl or alkenyl succinic anhydride and a polyamine with a cyclic carbonate, a linear mono- or poly carbonate, or a chloroformate. The '132 patent discloses succinimide alkenyl or alkyl groups containing from 10 to 300 carbon atoms; most preferred are alkenyl or alkyl groups having from 20 to 100 carbon atoms. However, the highest molecular weight alkenyl or alkyl group specifically taught in the Examples has a molecular weight of 1300. Furthermore, the '132 patent fails to teach anything about the fluorocarbon seal compatibility of the modified succinimides it discloses.

U.S. Pat. No. 4,747,965 discloses modified succinimides similar to those disclosed in the '132 patent, except that the modified succinimides disclosed in this patent are derived from succinimides having an average of greater than 1.0 succinic groups per alkenyl-derived substituent.

While it is known in the art that succinimide additives useful in controlling engine sludge and varnish may be substituted with alkenyl or alkyl groups ranging in number average molecular weight ("Mn") from approximately 300 to 5000, no reference teaches that substituents having a Mn of 2000–2700 perform better than those having a Mn of about 1300. Two references which discuss the effect of the alkenyl-derived substituent's molecular weight on the performance of succinimides as lubricating oil additives are "The Mechanism of Action of Polyisobutenyl Succinimide Lubricating Oil Additives," by E. S. Forbes and E. L. Neustadter (Tribology, Vol. 5, No. 2, pp. 72–77 (April, 1972)), and U.S. Pat. No. 4,234,435 ("the '435 patent").

The Forbes and Neustadter article discusses, in part, the effect of polyisobutenyl Mn on the detergency properties of a polyisobutenyl succinimide. However, as shown in FIG. 1 on page 76 of their article, the results of the tests Forbes and Neustadter conducted indicate that succinimides having a 1300 Mn polyisobutenyl substituent are more effective as detergents than those having a polyisobutenyl substituent with a Mn of 2000 or greater. In showing the effect of polyisobutenyl molecular weight on succinimide detergency, this article teaches that maximum detergency performance is obtained when the polyisobutenyl group has a Mn of about 1300.

The '435 patent teaches a preferred polyalkene-derived substituent group with a Mn in the range of 1500–3200. For polybutenes, an especially preferred Mn range is 1700–2400. However, the '435 patent also teaches that the succinimides must have a succinic ratio of at least 1.3, that is at least 1.3 succinic groups per equivalent weight of polyalkene-derived substituent group. Most preferred are succinimides having a succinic ratio of 1.5–2.5. The '435 patent teaches that succinimides must have have both a high Mn polyalkylene-derived substituent and a high succinic ratio.

The succinimide additives disclosed in the '435 patent are not only dispersants and/or detergents, but also viscosity index improvers. That is, the '435 additives impart fluidity modifying properties to lubricant compositions containing them. However, viscosity index improving properties are not always desirable for the succinimide, as in the case of single-grade oil formulations, for example.

Polyamino alkenyl or alkyl succinimides and other additives useful as dispersants and/or detergents, such as Mannich bases, contain basic nitrogen. While basicity is an important property to have in the dispersant/detergent additive, it is believed that the initial attack on fluorocarbon elastomer seals used in some engines involves attack by the basic nitrogen. This attack leads to the loss of fluoride ions, and eventually results in cracks in the seals and loss of other desirable physical properties in the elastomer.

One approach towards solving the elastomer problem is described in U.S. Pat. No. 4,873,009 to Ronald L. Anderson. This patent is also concerned, in part, with the use of succinimides as lube oil additives. Anderson recognizes in Col. 2, lines 28 et seq. that lube additives prepared from "long chain aliphatic polyamines", i.e., succinimides, "are excellent lube oil additives." Anderson teaches such succinimides are "inferior to additives where the alkylene polyamine is hydroxyalkylated" (Col. 2, lines 31–32). Such hydroxyalkylated polyamine-based succinimides, however, "have the drawback that they tend to attack engine seals particularly those of the fluorocarbon polymer type"(Col. 2, lines 35–37).

Anderson solves his fluorocarbon polymer seal compatibility problem by directly borating his hydroxyalkylated polyamine based succinimides. Furthermore, according to Anderson, it would be desirable for the additive to have a relatively high concentration of N-hydroxyalkyl moieties because the more N-hydroxyalkyl substituents, the cleaner the engine. However, Anderson also teaches that the more amino groups in the polyamine, the greater the degradation of fluorocarbon seal, and that alkylene amines containing more than 2 amino groups cannot be utilized (Col. 2, lines 50–62).

Accordingly, there exists a need in the art for a succinimide lubricating oil additive which is effective in controlling engine sludge and varnish, but which does not require boration to achieve fluorocarbon seal compatibility.

SUMMARY OF THE INVENTION

A unique class of modified polyamino alkenyl or alkyl succinimide compounds has now been found to be simultaneously compatible with fluorocarbon seals and, at concentration levels for which fluorocarbon seal compatibility is achieved, effective in controlling engine sludge and varnish. These modified polyamino alkenyl or alkyl succinimides are prepared from the succinimide reaction product of 1) an alkenyl- or alkyl-substituted succinic anhydride derived from a polyolefin having a Mn of about 2000 to about 2700 and a weight average molecular weight (Mw) to Mn ratio of about 1 to about 5; and 2) a polyalkylene polyamine having greater than 4 nitrogen atoms per mole. The modified succinimides of the present invention are obtained by post-treating the succinimide reaction product with a cyclic carbonate.

Among other factors, the present invention is based on the finding that a unique class of succinimides is effective in controlling engine sludge and varnish at concentration levels for which the succinimides are simultaneously compatible with engine fluorocarbon seals. Generally, known succinimides useful as dispersants and/or detergents are not always compatible with fluorocarbon seals when present in lubricating oil compositions at concentration levels necessary to be effective in controlling engine sludge and varnish. Accordingly, the present invention also relates to a lubricating oil composition containing these modified polyamino alkenyl or alkyl succinimides.

Among other factors, the present invention is also based on the finding that a unique class of modified polyamino alkenyl or alkyl succinimides wherein the alkenyl or alkyl substituent has a Mn in the range of 2000–2700 possess both superior fluorocarbon seal compatibility and superior dispersancy and/or detergency properties compared to those wherein the alkenyl or alkyl substituent has a Mn of less than about 2000.

In addition to lubricating oil compositions, the present invention also relates to fuel compositions comprising a major portion of a hydrocarbon boiling in a gasoline or diesel range and an amount of a modified polyamino alkenyl or alkyl succinimide, compatible with fluorocarbon seals, sufficient to provide dispersancy and/or detergency.

DETAILED DESCRIPTION OF THE INVENTION

The modified polyamino alkenyl or alkyl succinimides of this invention are prepared by post-treating a polyamino alkenyl or alkyl succinimide with a cyclic carbonate. The polyamino alkenyl or alkyl succinimides are typically prepared by reaction of an alkenyl or alkyl succinic anhydride with a polyamine.

Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference. The term "succinimide" is understood in the art to include many of the amide, imide and amidine species which are also formed by this reaction. The predominant product, however, is succinimide and this term has been generally accepted as meaning the product of a reaction of an alkenyl- or alkyl-substituted succinic acid or anhydride with a polyamine.

THE SUCCINIC ANHYDRIDE REACTANT

Various methods for the preparation of alkenyl- or alkyl-substituted succinic anhydride involving the reaction of a polyolefin and maleic anhydride have been described in the art. As mentioned above, such methods include a thermal process and a chlorination process. The thermal process is characterized by the thermal reaction of a polyolefin with maleic anhydride. The chlorination process is characterized by the reaction of a halogenated polyolefin, such as a chlorinated polyolefin, with maleic anhydride. Alternatively, the alkenyl- or alkyl-substituted succinic anhydride may be prepared as described in U.S. Pat. Nos. 4,388,471 and 4,450,281, which are totally incorporated herein by reference. Other examples of the preparation of alkenyl- or alkyl-substituted succinic anhydride are taught in U.S. Pat. Nos. 3,018,250 and 3,024,195, which are totally incorporated herein by reference.

In the case of the unique class of polyamino alkenyl or alkyl succinimide compounds of this invention, the alkenyl or alkyl succinic anhydride reactant is derived from a polyolefin having a Mn from about 2000 to about 2700 and a Mw/Mn ratio of about 1 to about 5. In a preferred embodiment, the alkenyl or alkyl group of the succinimide has a Mn value from about 2100 to about 2400. Most preferred are alkenyl or alkyl substituents having a Mn of about 2200.

Suitable polyolefin polymers for reaction with maleic anhydride include polymers comprising a major amount of $C_2$ to $C_5$ monoolefin, e.g., ethylene, propylene, butylene, iso-butylene and pentene. The polymers can be homopolymers such as polyisobutylene as well as copolymers of 2 or more such olefins such as copolymers of: ethylene and propylene, butylene, and isobutylene, etc. Other copolymers include those in which a minor amount of the copolymer monomers e.g., 1 to 20 mole percent, is a $C_4$ to $C_8$ nonconjugated diolefin, e.g., a copolymer of isobutylene and butadiene or a copolymer ethylene, propylene and 1,4-hexadiene, etc.

A particularly preferred class of olefin polymers for reaction with maleic anhydride comprises the polybutenes, which are prepared by polymerization of one or more of 1-butene 2-butene and isobutene. Especially desirable are polybutenes containing a substantial proportion of units derived from isobutene. The polybutene may contain minor amounts of butadiene which may or may not be incorporated in the polymer. These polybutenes are readily available commercial materials well known to those skilled in the art. Disclosures thereof will be found, for example, in U.S. Pat. Nos. 3,215,707; 3,231,587; 3,515,669; 3,579,450, and 3,912,764, as well as U.S. Pat. Nos. 4,152,499 and 4,605,808. The above are incorporated by reference for their disclosures of suitable polybutenes.

Suitable succinic anhydride reactants also include copolymers having alternating polyalkylene and succinic groups, such as those taught in U.S. Pat. No. 5,112,507, which is hereby incorporated by reference.

As used herein, the term "succinic ratio" refers to the average number of succinic groups per polyolefin group in the alkenyl or alkyl succinic anhydride reaction product of maleic anhydride and polyolefin. For example, a succinic ratio of 1.0 indicates an average of one succinic group per polyolefin group in the alkenyl or alkyl succinic anhydride product. Likewise, a succinic ratio of 1.35 indicates an average of 1.35 succinic groups per polyolefin group in the alkenyl or alkyl succinic anhydride product, and so forth.

The succinic ratio can be calculated from the saponification number (mg KOH per gram of sample), the actives content of the alkenyl or alkyl succinic anhydride product and the molecular weight of the starting polyolefin. The actives content of the alkenyl or alkyl succinic anhydride product is measured in terms of the actives fraction, wherein an actives fraction of 1.0 is equivalent to 100 weight percent actives. Accordingly, an actives fraction of 0.5 would correspond to 50 weight percent actives.

The succinic ratio of the alkenyl or alkyl succinic anhydride product of maleic anhydride and polyolefin can be calculated in accordance with the following equation:

$$\text{Succinic ratio} = \frac{M_{po} \times P}{(C \times A) - (M_{ma} \times P)}$$

wherein

P=saponification number of the alkenyl or alkyl succinic anhydride sample (mg KOH/g)

A=actives fraction of the alkenyl or alkyl succinic anhydride sample $M_{po}$=number average molecular weight of the starting polyolefin $M_{ma}$=98 (molecular weight of maleic anhydride)

C=conversion factor=112220 (for conversion of gram-moles of alkenyl or alkyl succinic anhydride per gram of sample to milligrams of KOH per gram of sample)

The saponification number, P, can be measured using known procedures, such as the procedure described in ASTM D94.

The actives fraction of the alkenyl or alkyl succinic anhydride can be determined from the percent of unreacted polyolefin according to the following procedure. A 5.0 gram sample of the reaction product of maleic anhydride and polyolefin is dissolved in hexane, placed in a column of 80.0 grams of silica gel (Davisil 62, a 140 angstrom pore size silica gel), and eluted with 1 liter of hexane. The percent unreacted polyolefin is determined by removing the hexane solvent under vacuum from the eluent and weighing the residue. Percent unreacted polyolefin is calculated according to the following formula:

$$\text{Percent Unreacted Polyolefin} = \frac{\text{Net Weight of Residue}}{\text{Sample Weight}} \times 100$$

The weight percent actives for the alkenyl or alkyl succinic anhydride product is calculated from the percent unreacted polyolefin using the formula:

The actives fraction of the alkenyl or alkyl succinic anhydride is then calculated as follows:

$$\text{Actives Fraction} = \frac{\text{Weight Percent Actives}}{100}$$

The percent conversion of polyolefin is calculated from the weight percent actives as follows:

$$\text{Percent Conversion} = \frac{\text{wt. \% actives} \times \left(\frac{M_{po}}{M_{po} + [M_{ma} \times SR]}\right)}{\left[\text{wt. \% actives} \times \left(\frac{M_{po}}{M_{po} + [M_{ma} \times SR]}\right)\right] + \left[100 - \text{wt. \% actives}\right]}$$

wherein $M_{po}$=number average molecular weight of the starting polyolefin $M_{ma}$=98 (molecular weight of maleic anhydride)

SR=succinic ratio of alkenyl or alkyl succinic anhydride product

It is, of course, understood that alkenyl or alkyl succinic anhydride products having high succinic ratios can be blended with other alkenyl succinic anhydrides having lower succinic ratios, for example, ratios of around 1.0, to provide an alkenyl succinic anhydride product having an intermediate succinic ratio.

In general, suitable succinic ratios for the alkenyl or alkyl succinic anhydride reactants employed in preparing the additives of this invention are greater than about 1 but less than about 2. Succinic anhydrides with succinic ratios of about 2, when reacted with amines having greater than 4 nitrogen atoms per mole and post-treated with a cyclic carbonate, form gels. Accordingly, succinic ratios of about 1.7 or less are preferred.

The Polyamine Reactant

The polyamine to be reacted with the alkenyl or alkyl succinic anhydride in order to produce the polyaminoalkenyl or alkyl succinimide employed in this invention is generally a polyalkylene polyamine. Preferably, the polyalkylene polyamine has greater than 4 amine nitrogen atoms per mole, up to a maximum of about 12 amine nitrogen atoms per mole. Most preferred are polyamines having from about 5 to about 7 nitrogen atoms per mole. The number of amine nitrogen atoms per mole of polyamine is calculated as follows:

$$\text{number of nitrogen atoms per mole of polyamine} = \frac{\% \text{ N} \times M_{pa}}{14 \times 100}$$

wherein

% N = percent nitrogen in polyamine or polyamine mixture $M_{pa}$ = number average molecular weight of the polyamine or polyamine mixture Preferred polyalkylene polyamines also contain from about 4 to about 40 carbon atoms, there being preferably from 2 to 3 carbon atoms per alkylene unit. The polyamine preferably has a carbon-to-nitrogen ratio of from about 1:1 to about 10:1.

The polyamine is so selected so as to provide at least one basic amine per succinimide. Since the reaction of the polyamino alkenyl or alkyl succinimide with a cyclic carbonate is believed to efficiently proceed through a primary or secondary amine, at least one of the basic amine atoms of the polyamino alkenyl or alkyl succinimide must either be a primary amine or a secondary amine. Accordingly, in those instances in which the succinimide contains only one basic amine, that amine must either be a primary amine or a secondary amine.

The polyamine portion of the polyamino alkenyl or alkyl succinimide may be substituted with substituents selected from (A) hydrogen, (B) hydrocarbyl groups of from 1 to about 10 carbon atoms, (C) acyl groups of from 2 to about 10 carbon atoms, and (D) monohydroxy, mononitro, monocyano, lower alkyl and lower alkoxy derivatives of (B) and (C). "Lower", as used in terms like lower alkyl or lower alkoxy, means a group containing from 1 to about 6 carbon atoms. At least one of the substituents on one of the amines of the polyamine is hydrogen, e.g., at least one of the basic nitrogen atoms of the polyamine is a primary or secondary amine nitrogen atom.

Examples of suitable polyamines that can be used to form the compounds of this invention include the following: tetraethylene pentamine, pentaethylene hexamine, heavy polyamine (number average MW=303, available from Dow Chemical Company, Midland, Mich.), and a heavy polyamine (number average MW=275, available from Union Carbide Corporation, Danbury, Conn.). Such amines encompass isomers such as branched-chain polyamines and the previously mentioned substituted polyamines, including hydrocarbyl-substituted polyamines. HPA-X heavy polyamine ("HPA-X") contains an average of approximately 6.5 nitrogen atoms per mole, and is a preferred polyamine.

In addition, the polyamine used as a reactant in the production of succinimides of the present invention need not be a single compound. Instead, the polyamine may be a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine.

Other examples of suitable polyamines include admixtures of amines of various sizes, provided that the overall mixture contains greater than 4 nitrogen atoms per mole. Included within these suitable polyamines are mixtures of diethylene triamine ("DETA") and heavy polyamine. A preferred polyamine admixture reactant is a mixture containing 20% by weight DETA and 80% by weight HPA-X; as determined by the method described above, this preferred polyamine reactant contains an average of about 5.2 nitrogen atoms per mole.

Methods of preparation of polyamines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volumes 2, pp. 99–116.

The reaction of a polyamine with an alkenyl or alkyl succinic anhydride to produce polyamino alkenyl or alkyl succinimides is well known in the art and is disclosed in U.S. Pat. Nos. 2,992,708; 3,018,291; 3,024,237; 3,100,673; 3,219,666; 3,172,892 and 3,272,746. The above are incorporated herein by reference for their disclosures of preparing alkenyl or alkyl succinimides.

Generally, a suitable molar charge of polyamine to alkenyl or alkyl succinic anhydride for making the compounds of this invention is from about 0.35:1 to about 0.6:1; although preferably from about 0.4:1 to about 0.5:1.

As used herein, the phrase "molar charge of polyamine to alkenyl or alkyl succinic anhydride" means the ratio of the number of moles of polyamine to the number of moles of succinic groups in the succinic anhydride reactant. The number of moles of succinic groups in the succinic anhydride reactant is determined as follows:

$$\text{number of moles of succinic groups} = \frac{P}{C} \times \text{weight of alkenyl or alkyl succinic anhydride sample (g)}$$

wherein P and C are as defined above.

Post-treatment of the Polyamino Alkenyl or Alkyl Succinimide with a Cyclic Carbonate The polyamino alkenyl or alkyl succinimides formed as described above are then reacted with a cyclic carbonate. The resulting modified polyamino alkenyl succinimide has one or more nitrogens of the polyamino moiety substituted with a hydroxy hydrocarbyl oxycarbonyl, a hydroxy poly(oxyalkylene) oxycarbonyl, a hydroxyalkylene, hydroxyalkylenepoly(oxyalkylene), or mixture thereof. The products so produced are compatible with fluorocarbon seals and are effective dispersant and detergent additives for lubricating oils and for fuels.

The reaction of a polyamino alkenyl or alkyl succinimide with a cyclic carbonate is conducted at a temperature sufficient to cause reaction of the cyclic carbonate with the polyamino alkenyl or alkyl succinimide. In particular, reaction temperatures of from about 0° C. to about 250° C. are preferred with temperatures of from about 100° C. to 200° C. being more preferred and temperatures of from 150° C. to 180° C. are most preferred.

The reaction may be conducted neat, wherein both the alkenyl or alkyl succinimide and the cyclic carbonate are combined in the proper ratio, either alone or in the presence of a catalyst (such as an acidic, basic or Lewis acid catalyst) and then stirred at the reaction temperature. Examples of suitable catalysts include, for instance, phosphoric acid, boron trifluoride, alkyl or aryl sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components may be stripped off. When a diluent is employed it is preferably inert to the reactants and products formed and is generally used in an amount sufficient to insure efficient stirring.

Water, which can be present in the polyamino alkenyl or alkyl succinimide, may be removed from the reaction system either before or during the course of the reaction via azeotroping or distillation. After reaction completion the system can be stripped at elevated temperatures (100° C. to 250° C.) and reduced pressures to remove any volatile components which may be present in the product.

Alternatively, a continuous system may be employed in which the alkenyl or alkyl succinic anhydride and polyamine are added at the front end of the system while the organic carbonate is added further downstream in the system. In such a continuous system, the organic carbonate may be added at any time after mixing of the alkenyl or alkyl succinic anhydride with the polyamine has occurred. Preferably, the organic carbonate is added within two hours after mixing of the alkenyl or alkyl succinic anhydride with the polyamine, preferably after the major portion of the amine has reacted with the anhydride.

In a continuous system, the reaction temperature may be adjusted to maximize reaction efficiency. Accordingly, the temperature employed in the reaction of the alkenyl or alkyl succinic anhydride with a polyamine may be the same as or different from that which is maintained for the reaction of this resulting product with the cyclic carbonate. In such a continuous system, the reaction temperature is generally between 0° to 250° C.; preferably between 125° C. to 200° C.; and most preferably between 150° C. to 180° C.

The reaction of polyamino alkenyl or alkyl succinimides with cyclic carbonates is known in the art and is described in U.S. Pat. No. 4,612,132, which is totally incorporated herein by reference.

A particularly preferred cyclic carbonate is 1,3-dioxolan-2-one (ethylene carbonate). Ethylene carbonate is commercially available or may be prepared by methods well-known in the art.

The molar charge of cyclic carbonate employed in the post-treatment reaction is based upon the theoretical number of basic nitrogens contained in the polyamino substituent of the succinimide. Thus, when 1 equivalent of tetraethylene pentamine ("TEPA") is reacted with two equivalents of succinic anhydride, the resulting his succinimide will theoretically contain 3 basic nitrogens. Accordingly, a molar charge of 2 would require that two moles of cyclic carbonate be added for each basic nitrogen or in this case 6 moles of cyclic carbonate for each mole of his succinimide prepared from TEPA. Mole ratios of the cyclic carbonate to the basic amine nitrogen of the polyamino alkenyl succinimide employed in the process of this invention are generally in the range of from about 1.5:1 to about 4:1; although preferably from about 2:1 to about 3:1.

As described in U.S. Pat. No. 4,612,132, cyclic carbonates may react with the primary and secondary amines of a polyamino alkenyl or alkyl succinimide to form two types of compounds. In the first instance, strong bases, including unhindered amines such as primary amines and some secondary amines, react with an equivalent of cyclic carbonate to produce a carbamic ester. In the second instance, hindered bases, such as hindered secondary amines, may react with an equivalent of the same cyclic carbonate to form a hydroxyalkyleneamine linkage. Unlike the carbamate products, the hydroxyalkyleneamine products retain their basicity.

Accordingly, the reaction of a cyclic carbonate with a polyamino alkenyl or alkyl succinimide may yield a mixture of products. When the molar charge of the cyclic carbonate to the basic nitrogen of the succinimide is about 1 or less, it is anticipated that a large portion of the primary and secondary amines of the succinimide will have been converted to hydroxy hydrocarbyl carbamic esters with some hydroxyhydrocarbylamine derivatives also being formed. A the mole ratio is raised above 1, poly(oxyalkylene) polymers of the carbamic esters and the hydroxyhydrocarbylamine derivatives are expected.

The modified succinimides of this invention can also be reacted with boric acid or a similar boron compound to borated dispersants having utility within the scope of this invention. In addition to boric acid (boron acid), examples of suitable boron compounds include boron oxides, boron halides and esters of boric acid. Generally from about 0.1 equivalents to 10 equivalents of boron compound to the modified succinimide may be employed.

Lubricating Oil Compositions and Concentrates Containing Modified Succinimides The modified polyamino alkenyl or alkyl succinimides of this invention are compatible with fluorocarbon seals. At concentration levels for which the additives of this invention are compatible with fluorocarbon seals, they are effective as detergent and dispersant additives when employed in lubricating oils. When employed in this manner the modified polyamino alkenyl or alkyl succinimide additive is usually present in from about 1 to about 5 percent by weight (on a dry polymer basis) to the total composition and preferably less than about 3 percent by weight (on a dry polymer basis).

As used herein, the phrase "dry polymer basis" indicates that only the modified succinimide compounds of this invention are considered when determining the amount of the additive relative to the remainder of a composition (e.g., lube oil composition, lube oil concentrate, fuel composition or fuel concentrate). Diluents and any other inactives are excluded.

The lubricating oil used with the additive compositions of this invention may be mineral oil or synthetic oils of lubricating viscosity and preferably suitable for use in the crankcase of an internal combustion engine. Crankcase lubricating oils ordinarily have a viscosity of about 1300 cSt at 0° F. to 22.7 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Other additives which may be present in the formulation include detergents (overbased and non-overbased), rust inhibitors, foam inhibitors, corrosion inhibitors, metal deactivators, pour point depressants, antioxidants, wear inhibitors, zinc dithiophosphates and a variety of other well-known additives.

It is also contemplated the modified succinimides of this invention may be employed as dispersants and detergents in hydraulic fluids, marine crankcase lubricants and the like. When so employed, the modified succinimide is added at from about 0.1 to 5 percent by weight (on a dry polymer basis) to the oil, and preferably at from 0.5 to 5 weight percent (on a dry polymer basis).

Additive concentrates are also included within the scope of this invention. The concentrates of this invention usually include from about 90 to 10 weight percent of an oil of lubricating viscosity and from about 10 to 90 weight percent (on a dry polymer basis) of the additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Fuel Composition and Concentrates Containing Modified Succinimides

When used in fuels, the proper concentration of the additive necessary in order to achieve the desired detergency is dependent upon a variety of factors including the type of fuel used, the presence of other detergents or dispersants or other additives, etc. Generally, however, and in the preferred embodiment, the range of concentration of the additive in the base fuel is 10 to 10,000 weight parts per million, preferably from 30 to 2,000 weight parts per million, of the modified succinimide per part of base fuel. If other detergents are present, a lesser amount of the modified succinimide may be used.

The modified succinimide additives of this invention may also be formulated as a fuel concentrate, using an inert stable oleophilic organic solvent boiling in the range of about 150° F. to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the fuel concentrate, the amount of the additive will be ordinarily at least 10 percent by weight and generally not exceed 70 percent by weight and preferably from 10 to 25 weight percent (all on a dry polymer basis).

The following examples are offered to specifically illustrate this invention. These examples and illustrations are not to be construed in any way as limiting the scope of this invention.

EXAMPLES

Example 1

Preparation of PIBSA 2200 (succinic ratio = 1.1)

A 35.186 Kg, 16 mol., sample of Parapol 2200 (a 2200 Mn polybutene available from Exxon Chemical Company) was charged to a reactor and heated to 232° C. During this time, the reactor was pressurized to 40 psig with nitrogen and then vented three times to remove oxygen. The reactor was pressurized to 24.7 psia. Then 1500 g maleic anhydride was added over a thirty-minute period. Then 4581 g maleic anhydride was added over a 4-hour period. The total charge mole ratio (CMR) of maleic anhydride to polybutene was 3.88. After the maleic anhydride addition was completed, the reaction was held at 232° C. for 1.5 hour. Then the reaction was cooled and the pressure reduced to 0.4 psia to remove any unreacted maleic anhydride. To this was then added a light neutral diluent oil. This was heated to 160° C. for 24 hours and was then filtered. This product was found to contain 37.68 wt. % actives and had a saponification number of 19.7 mg KOH/g sample. The succinic ratio was 1.1 based on a polybutene molecular weight of 2246 determined by GPC.

Example 2

Preparation of PIBSA 1300 (succinic ratio = 1.1)

The procedure of Example 1 was repeated except that Parapol 1300 (a 1300 Mn polybutene available from Exxon Chemical Company) was used instead of Parapol 2200. After dilution with diluent oil and filtration, this product was found to contain 49.6 wt. % actives and a saponification number of 42.2 mg KOH/g sample. The succinic ratio was 1.1 based on a polybutene molecular weight of 1300.

Example 3

Preparation of PIBSA 2200 (succinic ratio = 1.5)

Parapol 2200, 42.8 Kg, 19.45 mol, was charged to a reactor and the temperature was increased to 150° C. During this time, the reactor was pressurized to 40 psig with nitrogen and then vented three times to remove oxygen. Then at 150° C., maleic anhydride, 4294 g, 43.82 mol, and di-t-butylperoxide, 523 g, 3.58 mol, was added. The first 25% was added over 30 minutes. The remainder was then added over 11.5 hours. The CMR of maleic anhydride to polybutene was 2.25. The reaction was held at 150° C. for one hour. Then the reactor was heated to 190° C. for 1 hour to destroy any remaining di-t-butylperoxide. Then vacuum was applied to the reactor and the unreacted maleic anhydride was removed. This material was then diluted with a light neutral oil and filtered. The product after filtration had a saponification number of 31.6 g KOH/g sample and contained 45.62 wt. % actives. The succinic ratio was 1.5 for this material based on a polybutene molecular weight of 2200.

Example 4A

Preparation of PIBSA 1300 (succinic ratio = 1.9)

Parapol 1300, 6.9 Kg, 47.6 mol, was charged to a reactor and the temperature was increased to 150° C. During this time, the reactor was pressurized to 40 psig with nitrogen and then vented three times to remove oxygen. Then at 150° C., maleic anhydride, 9332.66 g (95.23 mol), and di-t-butylperoxide, 1280 g (8.77 mol) was added over 5 hours. Then the reaction was maintained at 150° C. for an additional 2 hours. The reaction was then heated to 190° C. for 1 hour to destroy any residual peroxide. The pressure was then reduced to 0.4 psia and the excess maleic anhydride was removed. The product was found to contain 65.4 wt. actives and had a saponification number of 94.5 mg KOH/g sample. The succinic ratio was 1.9 for this material based on a polybutene molecular weight of 1300.

Example 4B

Preparation of PIBSA 1300 (succinic ratio=1.5)

In order to produce a PIBSA with a succinic ratio of 1.5 the product from Example 4A, 629.1 g (succinic ratio 1.9), was blended with diluent oil, 786.1 g. and the PIBSA 1300 (succinic ratio=1.1) from Example 2, 962.8 g (succinic ratio 1.1). This gave 2388 g of PIBSA 1300 (succinic ratio=1.5) with a saponification number of 40.1 and wt. % actives of 35.4 and a succinic ratio of 1.5.

Example 5

Preparation of BIS HPA-X PIBSA 2200 Succinimide ( succinic ratio=1.1)

To a 22 L three-necked flask equipped with a Dean Stark trap was added 7655 g (1.34 mol) of PIBSA from Example 1. This was heated to 130° C. under nitrogen with stirring and to this was added HPA-X, 162.2 g (0.59 mol) over 2 hours. The temperature was increased to 165° C. The amine/PIBSA CMR was 0.44. The reaction was heated an additional 4 hours at 165° C. A total of 25 cc water was removed. This product was analyzed and found to contain 0.74% N, 17.0 TBN, 1.08 TAN, a viscosity at 100° C. of 427.6 cSt and a specific gravity at 15° C. of 0.9106. This product contained about 40% active material.

Examples 6–10, 13 and 14

Preparation of Other Succinimides

A number of other succinimides were prepared from a variety of PIBSA's and amines using the procedure reported in Example 5. The analytical data for these products are reported in Table I.

Example 11

Preparation of Ethylene Carbonate-Treated BIS HPA-X PIBSA 1300 (succinic ratio=1.1)

The product from Example 8, BIS HPA-X PIBSA 1300 (succinic ratio=1.1), 146.2 Kg, was charged to a reactor and the temperature was heated to 100° C. To this was added 20.4 Kg of ethylene carbonate over thirty minutes. The temperature was increased to 165° C. over 2.5 hours and then maintained at this temperature for 2 hours. A total of 14 Kg of product was obtained.

This product was analyzed and found to contain 1.51% N, 20.3 TBN, a viscosity at 100° C. of 446.6 cSt, and a specific gravity at 15° C. of 0.9393. The analytical data for this material is contained in Table I.

Examples 12, 13 and 15–19

Preparation of Other Ethylene Carbonate-Treated Succinimides

A number of other post-treated succinimides were prepared from a variety of succinimides prepared from a variety of PIBSA's and amines using the procedures reported in the previous examples. These materials are reported in Table I.

Example 20

Preparation of a Bis HPA-X Succinimide from PIBSA 1300 (succinic ratio=1.9)

PIBSA 1300 prepared as in Example 4 A (succinic ratio=1.9), 13051 g, was mixed with 10281 g diluent oil. This was heated to 75° C. and to this was added with stirring 1512 g HPA-X, 5.5 mol. The amine/PIBSA CMR was 0.5 and the wt. % actives were calculated to be about 40%. The temperature was heated to 169° C. over two hours and kept there for an additional two hours. Vacuum was applied to help remove the water. Upon cooling, a gel formed. So the reaction was reheated to 165° C under full vacuum for one additional hour. The product had 1.94% N, TBN=34.2, viscosity at 100° C. of 1267 cSt, and specific gravity at 15° C. of 0.9320. Then 2638 g of this product was charged to a reactor and heated to 165° C. To this was added 459.6 g ethylene carbonate (5.2 mol). The ethylene carbonate to basic nitrogen ratio was 2.0. When about half of the ethylene carbonate was added, massive amounts of a gel were formed. This could not be redissolved by prolonged heating or by the addition of 500 g diluent oil. The reaction was stopped. This reaction indicates that there is a gel problem when using PIBSA 1300 with a succinic ratio of 1.9.

TABLE I (Analytical Data For Examples 5–19)

| Compound of Example No.: | DESCRIPTION | MEASURED % N | TBN | VIS 100 (cSt) | SpGr (15° C.) |
|---|---|---|---|---|---|
| 5 | bis HPA-X PIBSA 2200 (SR = 1.1; A/P = 0.44) | 0.74 | 17 | 428 | 0.9106 |
| 6 | bis TETA PIBSA 1300 (SR = 1.1; A/P = 0.5) | 0.99 | 15 | 278 | 0.9300 |
| 7 | bis HPA-X PIBSA 2200 (SR = 1.5; A/P = 0.5) | 1.05 | 25 | 1688 | 0.9219 |
| 8 | bis HPA-X PIBSA 1300 (SR = 1.1; A/P = 0.5) | 1.55 | 36 | 272 | 0.9214 |
| 9 | bis TETA PIBSA 2200 (SR = 1.5; A/P = 0.5) | 0.64 | 10 | 1554 | 0.9339 |
| 10 | bis TETA PIBSA 2200 (SR = 1.1; A/P = 0.44) | 0.41 | 5 | 491 | 0.9093 |
| 11 | EC bis HPA-X PIBSA 1300 (SR = 1.1; A/P = 0.5; EC/BN = 2.0) | 1.51 | 20 | 447 | 0.9393 |

TABLE I-continued (Analytical Data For Examples 5–19)

| Compound of Example No.: | DESCRIPTION | MEASURED % N | TBN | VIS 100 (cSt) | SpGr (15° C.) |
|---|---|---|---|---|---|
| 12 | EC bis TETA PIBSA 1300 (SR = 1.5; A/P = 0.5; EC/BN = 2.0) | 0.96 | 8 | 305 | 0.9282 |
| 13 | bis TETA PIBSA 1300 (SR = 1.5; A/P = 0.5) | 0.87 | 15 | 145 | 0.9120 |
| 14 | bis HPA-X PIBSA 1300 (SR = 1.5; A/P = 0.5) | 1.52 | 37 | 165 | 0.9142 |
| 15 | EC bis TETA PIBSA 1300 (SR = 1.5; A/P = 0.5; EC/BN = 2.0) | 0.99 | 11 | 136 | 0.9156 |
| 16 | EC bis HPA-X PIBSA 1300 (SR = 1.5; A/P = 0.5; EC/BN = 2.0) | 1.46 | 19 | 402 | 0.9330 |
| 17 | EC bis HPA-X PIBSA 2200 (SR = 1.1; A/P = 0.44; EC/BN = 2.0) | 0.63 | 9 | 660 | 0.9188 |
| 18 | EC bis HPA-X/DETA PIBSA 2200 (SR = 1.1; A/P = 0.40; EC/BN = 2.4) | 0.44 | 6 | 485 | 0.9132 |
| 19 | EC bis HPA-X/DETA PIBSA 1300 (SR = 1.1; A/P = 0.5; EC/BN = 2.0) | 1.18 | 9.7 | 287 | |

Note:
SR = succinic ratio
A/P = amine/PIBSA CMR
EC/BN = ethylene carbonate/basic nitrogen CMR Blending of Samples on an Equal Basis We chose to blend and test the additives in Examples 5–19 on an equal wt. % actives basis. This was because we were trying to compare products from four different PIBSA's with different molecular weights and different succinic ratios, and two different amines with and without ethylene carbonate treatment. In order to do this, we calculated the % N and TBN that was expected for these compounds from the molecular formulas for a product that contained 40 wt. % actives. These data are reported in Table II. The succinimides from Examples 5–18 were then blended into the finished oil for testing at a concentration of 7.5% of the 40 wt. % actives material or at 3% on a dry polymer basis. The amounts of succinimides were adjusted to take into account the differences between the % N of the particular batch and the % N expected for the example. For Example 19, a 5% blend of 50 wt. % actives material or 3% on a dry polymer basis was made.

TABLE II

THEORETICAL % N AND TBN

| Compound of Example No.: | DESCRIPTION | % ACTIVE | % N | TBN |
|---|---|---|---|---|
| 5 | bis HPA-X PIBSA 2200 | 40 | 0.72 | 17 |
| 6 | bis TETA PIBSA 1300 | 40 | 0.77 | 12 |
| 7 | bis HPA-X PIBSA 2200 | 40 | 1.00 | 25 |
| 8 | bis HPA-X PIBSA 1300 | 40 | 1.14 | 26 |
| 9 | bis TETA PIBSA 2200 | 40 | 0.67 | 10 |
| 10 | bis TETA PIBSA 2200 | 40 | 0.48 | 5 |
| 11 | EC bis HPA-X PIBSA 1300 | 40 | 1.14 | 15 |
| 12 | EC bis TETA PIBSA 1300 | 40 | 0.77 | 6 |
| 13 | bis TETA PIBSA 1300 | 40 | 1.07 | 16 |
| 14 | bis HPA-X PIBSA 1300 | 40 | 1.57 | 38 |
| 15 | EC bis TETA PIBSA 1300 | 40 | 1.07 | 12 |
| 16 | EC bis HPA-X PIBSA 1300 | 40 | 1.57 | 20 |
| 17 | EC bis HPA-X PIBSA 2200 | 40 | 0.72 | 10 |
| 18 | EC bis HPA-X/DETA PIBSA 2200 | 40 | 0.59 | 7 |
| 19 | EC bis HPA-X/DETA PIBSA 1300 | 50 | 1.18 | 10 |

The additive compounds prepared in accordance with preceding Examples 5–19 were tested for fluorocarbon seal compatibility using the Volkswagon PV-3344 test procedure for seal testing of motor oils. The results are displayed in Table III. The PV-3344 test procedure is a revised version of the earlier PV-3344 test procedure. This test procedure measures the change in physical properties of elastomer seals after they have been suspended in an oil solution. Tensile strength (TS) and elongation (EL) of the elastomer seals are measured. In addition, the seals are also visually inspected for cracks (CR) after they are removed from the test oil. Details of the PV-3344 test procedure are available from Volkswagon.

TABLE III (PV-3344 TEST RESULTS)

| Additive Compound of Example No. | Concentration of Additive (Wt. %) | TS (Pass ≧ 8.0) | EL (Pass ≧ 160) | CR (Pass = N) |
|---|---|---|---|---|
| 5 | 1.6 | 10.0 | 203 | N |
| | 2.0 | 9.4 | 189 | N |
| | 2.4 | 8.8 | 196 | N |
| | 2.4 | 8.0 | 175 | Y |
| | 2.8 | 7.8 | 176 | Y |
| | 3.2 | 7.2 | 167 | Y |
| 6 | 1.6 | 10.8 | 218 | N |
| | 2.4 | 9.6 | 197 | N |
| 7 | 1.6 | 10.9 | 220 | N |
| 8 | 1.6 | 6.5 | 155 | Y |
| | 2.4 | 6.0 | 146 | Y |
| 9 | 1.6 | 11.7 | 232 | N |
| 10 | 1.6 | 12.5 | 244 | N |
| | 3.2 | 11.7 | 240 | N |
| 11 | 1.6 | 6.0 | 139 | Y |
| | 2.8 | 5.8 | 141 | Y |
| 12 | 1.6 | 10.9 | 216 | N |
| 13 | 1.6 | 11.2 | 224 | N |
| | 2.4 | 9.4 | 196 | N |
| 14 | 1.6 | 6.9 | 160 | Y |
| | 2.4 | 5.6 | 137 | Y |
| 15 | 1.6 | 11.7 | 233 | N |
| | 2.4 | 10.7 | 207 | N |
| 16 | 1.6 | 6.8 | 153 | Y |
| | 2.4 | 6.4 | 148 | Y |
| 17 | 1.6 | 9.0 | 188 | N |
| | 2.0 | 8.8 | 180 | N |
| | 2.4 | 8.8 | 196 | N |
| | 2.8 | 7.5 | 172 | Y |
| | 3.2 | 7.9 | 169 | Y |
| 18 | 1.6 | 12.1 | 238 | N |
| | 2.0 | 11.6 | 233 | N |
| | 2.4 | 11.1 | 220 | N |
| | 2.8 | 10.7 | 220 | N |

TABLE III-continued

| Additive Compound of Example No. | Concentration of Additive (Wt. %) | TS (Pass ≧ 8.0) | EL (Pass ≧ 160) | CR (Pass = N) |
|---|---|---|---|---|
| | (PV-3344 TEST RESULTS) | | | |
| | 3.2 | 10.0 | 206 | N |
| 19 | 1.6 | 10.1 | 186 | N |
| | 2.8 | 8.3 | 150 | Y |

The detergency properties of the additive compounds were then tested using the Sequence VE engine test procedure, as defined in ASTM Proposed Method:212. This test measures, among other things, average engine sludge (AES) and average engine varnish (AEV). The AES and AEV results for the compounds of Examples 5–19 are shown in Table IV. A dosage or treat rate level of 3.0% (on a dry polymer basis) was chosen as an appropriate concentration level for the Seq. VE test since treat rate levels exceeding 3% are generally too high for the resulting additive package to be priced competitively in the marketplace. Examples 17 and 18 were each run at concentration levels of 2.0 and 1.5% (on a dry polymer basis).

TABLE IV

| Compound of Example No. | Dose (Wt. %) | AES (Pass ≧ 9.0) | AEV (Pass ≧ 5.0) |
|---|---|---|---|
| | (SEQ. VE TEST RESULTS) | | |
| 5 | 3.0 | 9.4 | 5.6 |
| 6 | 3.0 | 8.0 | 3.4 |
| 7 | 3.0 | 9.5 | 6.0 |
| 8 | 3.0 | 7.7 | 4.6 |
| 9 | 3.0 | 9.3 | 5.6 |
| 10 | 3.0 | 8.9 | 4.0 |
| 11 | 3.0 | 9.1 | 5.9 |
| 12 | 3.0 | 8.7 | 4.1 |
| 13 | 3.0 | 9.1 | 5.1 |
| 14 | 3.0 | 9.3 | 5.4 |
| 15 | 3.0 | 9.4 | 5.3 |
| 16 | 3.0 | 9.4 | 6.4 |
| 17 | 2.0 | 9.4 | 5.9 |
| | 1.5 | 9.2 | 5.3 |
| 18 | 2.0 | 9.3 | 5.1 |
| | 1.5 | 8.7 | 4.4 |
| 19 | 3.0 | 8.9 | 4.7 |

Tables V–VII examine the effect of three structural parameters on PV-3344 and Seq. VE test performance. TS data (@ a concentration level of 1.6 wt. %) is used as an indication of PV-3344 test performance. AES and AEV data are used as an indication of Seq. VE test performance. Table V shows the effect of the polybutene substituent's molecular weight on the additive's performance in both tests; Table VI shows the effect of the number of amine nitrogen atom per mole on the additive's performance in both tests; and Table VII shows the effect of post-treatment with ethylene carbonate on the additive's performance in both tests.

In Tables V–VII, the compounds are listed in pairs. For each pair, the compounds differ only by the feature examined in the respective table. For instance, the first pair of compounds listed in Table V (effect of polybutene Mn) compares Examples 6 and 10. Example 6 has a succinic ratio of 1.1, is made from a TETA polyamine, is not post-treated with ethylene carbonate, and contains a 1300 Mn polybutene substituent. Example 10 likewise has a succinic ratio of 1.1, is made from a TETA polyamine, and is not post-treated with ethylene carbonate. However, Example 10 contains a 2200 Mn polyisobutene substituent.

TABLE V

| Compound of Example No.: | Succinic Ratio | Amine Type | Ethylene Carbonate Post-Treatment | Polybutene Mn | PV-3344 TS | Seq. VE AES | Seq. VE AEV |
|---|---|---|---|---|---|---|---|
| | | | (EFFECT OF POLYBUTENE Mn) | | | | |
| 6 | 1.1 | TETA | No | 1300 | 10.8 | 8.0 | 3.4 |
| 10 | 1.1 | TETA | No | 2200 | 12.5 | 8.9 | 4.0 |
| 8 | 1.1 | HPA-X | No | 1300 | 6.5 | 7.7 | 4.6 |
| 5 | 1.1 | HPA-X | No | 2200 | 10.0 | 9.4 | 5.6 |
| 11 | 1.1 | HPA-X | Yes | 1300 | 6.0 | 9.1 | 5.9 |
| 17 | 1.1 | HPA-X | Yes | 2200 | 9.0 | 9.4 | 5.9 |
| 14 | 1.5 | HPA-X | No | 1300 | 6.9 | 9.3 | 5.4 |
| 7 | 1.5 | HPA-X | No | 2200 | 10.9 | 9.5 | 6.0 |
| 13 | 1.5 | TETA | No | 1300 | 11.2 | 9.1 | 5.1 |
| 9 | 1.5 | TETA | No | 2200 | 11.7 | 9.3 | 5.6 |
| Average | — | — | — | 1300 | 8.3 | 8.6 | 4.9 |
| Average | — | — | — | 2200 | 10.8 | 9.3 | 5.4 |

Table V demonstrates that a polyisobutene Mn of 2200 gives better PV-3344 and better Seq. VE results than a polyisobutene Mn of 1300.

TABLE VI (EFFECT OF AMINE TYPE)

| Compound of Example No.: | Polybutene Mn | Succinic Ratio | Ethylene Carbonate Post-Treatment | Amine Type | PV-3344 TS | Seq. VE AES | Seq. VE AEV |
|---|---|---|---|---|---|---|---|
| 6 | 1300 | 1.1 | No | TETA | 10.8 | 8.0 | 3.4 |
| 8 | 1300 | 1.1 | No | HPA-X | 6.5 | 7.7 | 4.6 |
| 10 | 2200 | 1.1 | No | TETA | 12.5 | 8.9 | 4.0 |
| 5 | 2200 | 1.1 | No | HPA-X | 10.0 | 9.4 | 5.6 |
| 9 | 2200 | 1.5 | No | TETA | 11.7 | 9.3 | 5.6 |
| 7 | 2200 | 1.5 | No | HPA-X | 10.9 | 9.5 | 6.0 |
| 12 | 1300 | 1.1 | Yes | TETA | 10.9 | 8.7 | 4.1 |
| 11 | 1300 | 1.1 | Yes | HPA-X | 6.0 | 9.1 | 5.9 |
| 13 | 1300 | 1.5 | No | TETA | 11.2 | 9.1 | 5.1 |
| 14 | 1300 | 1.5 | No | HPA-X | 6.9 | 9.3 | 5.4 |
| 15 | 1300 | 1.5 | Yes | TETA | 11.7 | 9.4 | 5.3 |
| 16 | 1300 | 1.5 | Yes | HPA-X | 6.8 | 9.4 | 6.4 |
| Average | — | — | — | TETA | 11.5 | 8.9 | 4.6 |
| Average | — | — | — | HPA-X | 7.9 | 9.1 | 5.6 |
| 17 | 2200 | 1.1 | Yes | HPA-X | 9.0 | 9.4 | 5.9 |
| 18 | 2200 | 1.1 | Yes | DETA/ HPA-X | 12.1 | 9.3 | 5.1 |
| 11 | 1300 | 1.1 | Yes | HPA-X | 6.0 | 9.1 | 5.9 |
| 19 | 1300 | 1.1 | Yes | DETA/ HPA-X | 10.1 | 8.9 | 4.7 |
| Average | — | — | — | HPA-X | 7.5 | 9.25 | 5.9 |
| Average | — | — | — | DETA/ HPA-X | 11.1 | 9.1 | 4.9 |

when comparing TETA (4 N atoms per mole) and HPA-X (avg. of 6.5 N atom per mole) polyamines, Table VI shows better PV-3344 performance for TETA. The Seq. VE (AES) results for HPA-X were slightly better than for TETA. Also, Seq. VE (AEV) results were significantly better for the HPA-X polyamine than for TETA. While TETA appears to be the best amine type for PV-3344 performance, it is unacceptable for Seq. VE performance. The concentration levels of additives containing a TETA amine necessary to achieve suitable Seq. VE performance (AEV in particular) are generally unacceptable because they are too high to allow for a competitive treat rate.

The comparison of HPA-X and an admixture of DETA/HPA-X in Table VI shows that the DETA/HPA-X polyamine gave significantly better PV-3344 results. This comparison also shows that HPA-X was slightly better than the DETA/HPA-X admixture for Seq. VE (AES) results. Also, the Seq. VE (AEV) results were better for HPA-X than for the DETA/HPA-X admixture.

TABLE VII (EFFECT OF POST-TREATMENT WITH ETHYLENE CARBONATE)

| Compound of Example No.: | Polybutene Mn | Succinic Ratio | Amine Type | Ethylene Carbonate Post-Treatment | PV-3344 TS | Seq. VE AES | Seq. VE AEV |
|---|---|---|---|---|---|---|---|
| 5 | 2200 | 1.1 | HPA-X | No | 10.0 | 9.4 | 5.6 |
| 17 | 2200 | 1.1 | HPA-X | Yes | 9.0 | 9.4 | 5.9 |
| 6 | 1300 | 1.1 | TETA | No | 10.8 | 8.0 | 3.4 |
| 12 | 1300 | 1.1 | TETA | Yes | 10.9 | 8.7 | 4.1 |
| 8 | 1300 | 1.1 | HPA-X | No | 6.5 | 7.7 | 4.6 |
| 11 | 1300 | 1.1 | HPA-X | Yes | 6.0 | 9.1 | 5.9 |
| 13 | 1300 | 1.5 | TETA | No | 11.2 | 9.1 | 5.1 |
| 15 | 1300 | 1.5 | TETA | Yes | 11.7 | 9.4 | 5.3 |
| 14 | 1300 | 1.5 | HPA-X | No | 6.9 | 9.3 | 5.4 |
| 16 | 1300 | 1.5 | HPA-X | Yes | 6.8 | 9.4 | 6.4 |
| Average | — | — | — | No | 9.1 | 8.7 | 4.8 |
| Average | — | — | — | Yes | 8.9 | 9.2 | 5.5 |

Table VII shows that post-treatment with ethylene carbonate gives slightly poorer PV-3344 performance than without post-treatment. However, those succinimides which were modified by post-treatment with ethylene carbonate performed significantly better in the Seq. VE test (both AES and AEV).

The conclusions that can be drawn from the above Tables are summarized in Table VIII.

TABLE VIII (CONCLUSIONS)

| | Better PV-3344 Performance | Better Seq. VE (AES) Performance | Better Seq. VE (AEV) Performance |
|---|---|---|---|
| A. Polyisobutene Mn (1300 or (2200) | 2200 | 2200 | 2200 |
| B. Post-Treatment (Yes or No) with ethylene carbonate | No (slightly) | Yes | Yes |
| C. Amine type | | | |
| 1. TETA or HPA-X | TETA | HPA-X (slightly) | HPA-X |
| 2. HPA or DETA/HPA-X | DETA/ HPA-X | HPA-X (slightly) | HPA-X |

Table VIII shows that the most desirable additives contain a 2200 Mn substituent, are derived from a polyamine having greater than 4 nitrogen atoms per mole, and are post-treated with ethylene carbonate.

While TETA appears to be the best amine type for PV-3344 performance, the concentration levels required for this amine type to achieve suitable Seq. VE performance (AEV results in particular) are unacceptable because they are too high to allow for a competitive treat rate. Accordingly, the amine should have greater than 4 nitrogen atoms per mole.

For multi-grade oil applications, the succinimide additive may be derived from a succinic anhydride having a succinic ratio of approximately 1.5. However, the viscosity index improvement which accompanies succinimides having succinic ratios of about 1.3 or greater is not always desirable. Instead, for some applications, such as single-grade oil formulation, a succinic ratio less than about 1.3, preferably closer to 1, is more desirable. Furthermore, Example 20 (made from the PIBSA of Example 4A) shows that succinic ratios of about 1.9 are unacceptable because gels are formed. Accordingly, succinic ratios greater than 1 but less than about 2 are acceptable, with succinic ratios less than about 1.7 preferred.

Succinimide additives having a 2200 Mn alkenyl or alkyl group which are derived from an amine having greater than 4 nitrogen atoms per mole, and which are post-treated with ethylene carbonate, are compatible with fluorocarbon seals at concentration levels for which they are excellent detergent additives. Such additive compounds (Examples 17 and 18) pass the Seq. VE test at low concentration levels and are desirable because less of the additive is needed in additive packages, thereby resulting in lower-cost oil formulations.

What is claimed is:

1. A modified polyamino alkenyl or alkyl succinimide comprising the succinimide reaction product of:

(i) an alkenyl- or alkyl-substituted succinic anhydride derived from a polyolefin having a Mn of about 2000 to about 2700 and a Mw/Mn ratio of about 1 to about 5; and (ii) a polyalkylene polyamine having greater than 4 nitrogen atoms per mole;

wherein the succinimide reaction product is post-treated with a cyclic carbonate.

2. A modified polyamino alkenyl or alkyl succinimide according to claim 1 wherein the charge mole ratio of (ii) to (i) is from about 0.35:1 to about 0.6:1; and the charge mole ratio of cyclic carbonate to basic amine nitrogen in the succinimide reaction product is from about 1.5:1 to about 4:1.

3. A modified polyamino alkenyl or alkyl succinimide according to claim 1 wherein the polyolefin has a Mn value of about 2100 to about 2400.

4. A modified polyamino alkenyl or alkyl succinimide according to claim 3 wherein the polyolefin has a Mn value of about 2200.

5. A modified polyamino alkenyl or alkyl succinimide according to claim 1 wherein the polyolefin is polybutene.

6. A modified polyamino alkenyl or alkyl succinimide according to claim 5 wherein the polybutene is polyisobutene.

7. A modified polyamino alkenyl or alkyl succinimide according to claim 1 wherein the polyalkylene polyamine has greater than 4 to about 12 nitrogen atoms per mole.

8. A modified polyamino alkenyl or alkyl succinimide according to claim 7 wherein the polyalkylene polyamine has from about 5 to about 7 nitrogen atoms per mole.

9. A modified polyamino alkenyl or alkyl succinimide according to claim 8 wherein the polyalkylene polyamine is Union Carbide HPA-X heavy polyamine.

10. A modified polyamino alkenyl or alkyl succinimide according to claim 8 wherein the polyalkylene polyamine comprises 20% by weight diethylene triamine and 80% by weight heavy polyamine.

11. A modified polyamino alkenyl or alkyl succinimide according to claim 1 wherein the succinic anhydride has a succinic ratio from about 1 to less than about 2.

12. A modified polyamino alkenyl or alkyl succinimide according to claim wherein the succinic anhydride has a succinic ratio from about 1 to less than about 1.3.

13. A modified polyamino alkenyl or alkyl succinimide according to claim wherein the succinic anhydride has a succinic ratio from about 1.3 to about 1.7.

14. A modified polyamino alkenyl succinimide according to claim 1 wherein the cyclic carbonate is ethylene carbonate.

15. A modified polyamino alkenyl or alkyl succinimide according to claim 1 wherein the polyolefin is polyisobutene having a Mn of about 2200, the succinic anhydride has a succinic ratio from about 1 to about 1.7, the polyalkylene polyamine comprises heavy polyamine having a Mn of 275, the charge mole ratio of (ii) to (i) is from about 0.4:1 to about 0.5:1, the cyclic carbonate is ethylene carbonate, and the charge mole ratio of cyclic carbonate to basic amine nitrogen in the succinimide reaction product is from about 2:1 to about 3:1.

16. A modified polyamino alkenyl or alkyl succinimide according to claim 1 wherein the polyolefin is polyisobutene having a Ma of about 2200, the succinic anhydride has a succinic ratio from about 1 to about 1.7, the polyalkylene polyamine comprises 20% by weight diethylene triamine and 80% by weight heavy polyamine having a Mn of 275, the charge mole ratio of (ii) to (i) is from about 0.4:1 to about 0.5:1, the cyclic carbonate is ethylene carbonate, and the charge mole ratio of cyclic carbonate to basic amine nitrogen in the succinimide reaction product is from about 2:1 to about 3:1.

17. A lubricating oil composition comprising a major amount of an oil of lubricating viscosity and an effective amount of a modified polyamino alkenyl or alkyl succinimide sufficient to be compatible with fluorocarbon seals and simultaneously control engine sludge and varnish, wherein the modified succinimide comprises the succinimide reaction product of:

(i) an alkenyl- or alkyl-substituted succinic anhydride derived from a polyolefin having a Mn of about 2000 to about 2700 and a Mw/Mn ratio of about 1 to about 5; and (ii) a polyalkylene polyamine having greater than 4 nitrogen atoms per mole;

wherein the succinimide reaction product is post-treated with a cyclic carbonate.

18. A lubricating oil composition according to claim 17 wherein the charge mole ratio of (ii) to (i) is from about 0.35:1 to about 0.6:1; and the charge mole ratio of cyclic carbonate to basic amine nitrogen in the succinimide reaction product is from about 1.5:1 to about 4:1.

19. A lubricating oil composition according to claim 17 wherein the polyolefin has a Mn of about 2100 to about 2400.

20. A lubricating oil composition according to claim 19 wherein the polyolefin has a Mn of about 2200.

21. A lubricating oil composition according to claim 17 wherein the polyolefin is polybutene.

22. A lubricating oil composition according to claim 21 wherein the polybutene is polyisobutene.

23. A lubricating oil composition according to claim 17 wherein the polyalkylene polyamine has greater than 4 to about 12 nitrogen atoms per mole.

24. A lubricating oil composition according to claim 23 wherein the polyalkylene polyamine has from about 5 to about 7 nitrogen atoms per mole.

25. A lubricating oil composition according to claim 24 wherein the heavy polyamine is Union Carbide HPA-X heavy polyamine.

26. A lubricating oil composition according to claim 24 wherein the polyalkylene polyamine comprises 20% by weight diethylene triamine and 80% by weight heavy polyamine.

27. A lubricating oil composition according to claim 17 wherein the succinic anhydride has a succinic ratio from about 1 to less than about 2.

28. A lubricating oil composition according to claim 27 wherein the succinic anhydride has a succinic ratio from about 1 to less than about 1.3.

29. A lubricating oil composition according to claim 27 wherein the succinic anhydride has a succinic ratio from about 1.3 to about 1.7.

30. A lubricating oil composition according to claim 17 wherein the cyclic carbonate is ethylene carbonate.

31. A lubricating oil composition according to claim 17 wherein the amount of the modified polyamino alkenyl or alkyl succinimide is from about 1 to about 5 weight percent on a dry polymer basis.

32. A lubricating oil composition according to claim 31 wherein the amount of the modified polyamino alkenyl or alkyl succinimide is lees than about 3 weight percent on a dry polymer basis.

33. A lubricating oil composition according to claim 17 wherein the amount of the modified polyamino alkenyl or alkyl succinimide is less than about 3 weight percent on a dry polymer basis and wherein the polyolefin is polyisobutene having a Mn of about 2200, the succinic anhydride has a succinic ratio from about 1 to about 1.7, the polyalkylene polyamine comprises heavy polyamine having a Mn of 275, the charge mole ratio of (ii) to (i) is from about 0.4:1 to about 0.5:1, the cyclic carbonate is ethylene carbonate, and the charge mole ratio of cyclic carbonate to basic amine nitrogen in the succinimide reaction product is from about 2:1 to about 3:1.

34. A lubricating oil composition according to claim 17 wherein The amount of the modified polyamino alkenyl or alkyl succinimide is less than about 3 weight percent on a dry polymer basis and wherein the polyolefin is polyisobutene having a Mn of about 2200, the succinic anhydride has a succinic ratio from about 1 to about 1.7, the polyalkylene polyamine comprises 20% by weight diethylene triamine and 80% by weight heavy polyamine having Mn of 275, the charge mole ratio of (ii) to (i) is from about 0.4:1 to about 0.5:1, the cyclic carbonate is ethylene carbonate, and the charge mole ratio of cyclic carbonate to basic amine nitrogen in the succinimide reaction product is from about 2:1 to about 3: 1.

35. A lubricating oil concentrate comprising from about 90 to about 10 weight percent of an oil of lubricating viscosity and from about 10 to about 90 weight percent on a dry polymer basis of a modified polyamino alkenyl or alkyl succinimide comprising the succinimide reaction product of:

(i) an alkenyl- or alkyl-substituted succinic anhydride derived from a polyolefin having a Mn of about 2000 to about 2700 and a Mw/Mn ratio of about 1 to about 5; and (ii) a polyalkylene polyamine having greater than 4 nitrogen atoms per mole;

wherein the succinimide reaction product is post-treated with a cyclic carbonate.

36. A lubricating oil concentrate according to claim 35 wherein the polyolefin is polyisobutene having a Mn of about 2200, the succinic anhydride has a succinic ratio from about 1 to about 1.7, the polyalkylene polyamine comprises having a Mn of 275, polyamine, the charge mole ratio of (ii) to (i) is from about 0.4:1 to about 0.5:1, the cyclic carbonate is ethylene carbonate, and the charge mole ratio of cyclic carbonate to basic amine nitrogen in the succinimide reaction product is from about 2:1 to about 3:1.

37. A lubricating oil concentrate according to claim 35 wherein the polyolefin is polyisobutene having a Mn of about 2200,the succinic anhydride has a succinic ratio from about 1 to about 1.7, the polyalkylene polyamine comprises 20% by weight diethylene triamine and 80% by weight heavy polyamine having a Mn of 275, the charge mole ratio of (ii) to (i) is from about 0.4:1 to about the cyclic carbonate is ethylene carbonate, and the charge mole ratio of cyclic carbonate to basic amine nitrogen in the succinimide reaction product is from about 2:1 to about 3:1.

* * * * *